US005224637A

United States Patent [19]

Colombo

[11] Patent Number: 5,224,637

[45] Date of Patent: Jul. 6, 1993

[54] WAIST-MOUNTED INFANT CARRIER

[76] Inventor: Margaret A. Colombo, 7769 Dryer Rd., Victor, N.Y. 14564

[21] Appl. No.: 753,435

[22] Filed: Aug. 30, 1991

[51] Int. Cl.[5] ..... A01G 1/00

[52] U.S. Cl. ..... 224/159; 224/158; 224/208

[58] Field of Search ..... 224/158, 159, 160, 161, 224/224, 226, 225, 270, 901, 907, 264, 204, 208, 211, 214, 224; 297/4, 465, 464, 463

[56] References Cited

U.S. PATENT DOCUMENTS

| | | | |
|---|---|---|---|
| 484,065 | 10/1892 | Taylor | 224/160 |
| 576,292 | 2/1897 | Vanderburgh | 224/159 |
| 781,033 | 1/1905 | Sutter | 297/4 |
| 1,464,404 | 8/1923 | Blekastad | 224/159 |
| 2,409,331 | 10/1946 | Wood | 224/159 |
| 2,411,721 | 11/1946 | Hancock et al. | 224/159 |
| 3,197,100 | 7/1965 | Thompson | 224/160 |
| 4,029,243 | 6/1977 | Zerobnick et al. | 224/224 |
| 4,440,525 | 4/1984 | Perla | 224/224 X |
| 4,790,459 | 12/1988 | Moseley | 224/159 |
| 4,901,898 | 2/1990 | Colombo et al. | 224/224 X |
| 4,915,277 | 4/1990 | Larreategui | 224/159 |
| 5,011,056 | 4/1991 | Larreategui | 224/159 |
| 5,016,791 | 5/1991 | Burow | 224/224 X |
| 5,060,835 | 10/1991 | Payne | 224/224 |

*Primary Examiner*—Henry J. Recla
*Assistant Examiner*—Glenn T. Barrett
*Attorney, Agent, or Firm*—Warren W. Kurz

[57] ABSTRACT

An infant carrier adapted to be worn about the waist of an adult for supporting and transporting an infant on the hip region of the wearer. According to a preferred embodiment, such carrier comprises a fabric belt and an integral fabric seat portion which is adapted to receive and support an infant who is positioned to face the adult wearer with legs straddling the wearer's waist. The integral seat portion is defined by a section of the belt, a loop of fabric extending away from and back to the belt section at spaced locations, and a pair of spaced gussets, positioned one above the other and connecting the belt section and the loop portion. A compressible member, such as polyurethane, foam rubber, or a bladder of air, is disposed in the volume defined by the aforementioned seat-defining members. By virtue of the integral belt/seat design, the weight of the infant is more broadly distributed about the wearer's waist and hip region, and the product is considerably easier manufacture compared to prior art infant carriers of the same type.

18 Claims, 2 Drawing Sheets

WAIST-MOUNTED INFANT CARRIER

BACKGROUND OF THE INVENTION

The present invention related to improvements in apparatus for carrying and transporting infants and small children. More particularly, it relates to improvements in infant carriers of the type which are adapted to be worn by an adult and serve to support an infant at or about the waist level of the adult wearer.

From time immemorial, adults have carried infant children in the very natural position in which the child's legs straddle the adult's waist with the child's buttocks resting against the adult's hip bone. This position allows the adult to support the child's back with one arm, allowing the other arm to be used for other purposes. While the adult's hip provides some support for the child, it is the arm which bears most of the child's weight. As everyone knows who has carried infants in this manner, the arm soon grows weary and it is necessary to keep shifting the child from one side to the other in order to rest one arm or the other.

To alleviate the strain on the arms of those who carry infants for any extended period of time in the manner described above, many different types of infant-carrying devices have been proposed. Such devices serve, in effect, to shift all or most of the weight of the infant from the bearer's arms to other body portions. See, for example, the infant carriers disclosed in U.S. Pat. Nos. 484,065; 576,292; 781,033; 2,409,331; 2,411,721; and 3,197,100. All of the infant carriers disclosed in these patents have in common a platform of some sort for supporting the infant at waist level, and one or more straps for suspending such platform from the shoulder(s) or neck of the wearer. While infant carriers of this type are advantageous from the standpoints that they do provide a more secure support for the infant, they tend to be problematic in that their associated support straps tend to strain the shoulder and neck muscles of the wearer. Moreover, these shoulder straps are sometimes a nuisance for the wearer to put on, and often present an obstacle in properly positioning the infant in the carrier.

In the commonly owned U.S. Pat. No. 4,901,898, there is disclosed a waist-mounted infant carrier that alleviates the shoulder and neck strain associated with infant carriers of the above type. This particular infant carrier is adapted to be worn about the waist of an adult and, according to a preferred embodiment, basically comprises a shaped member having a generally V-shaped cross section. Such member defines contoured seat and skirt portions joined along an arcuate line approximating the waist line of the intended wearer. The contoured seat portion has a shape adapted to receive and support the buttocks of an infant who is positioned to face the adult wearer with legs straddling the wearer's waist. The contoured skirt portion is shaped to the hip region of the wearer and is adapted to fit inside the waist band of the wearer's skirt or pants so that the shaped member is supported along the arcuate line along which the seat and skirt portions are joined. Alternatively, a belt is provided for securing the shaped member to the wearer's waist. Somewhat similar infant carriers are disclosed in French Patent No. 1,215,795, and in U.S. Pat. Nos. 1,464,404 and 4,790,459.

According to a second embodiment disclosed in the above-mentioned U.S. Pat. No. 4,901,898, the shaped seat member is molded from a resilient material, such as sponge rubber or foamed polyurethane, and a rigid V-shaped member, made of plastic or metal is embedded in the molded seat to reinforce the support for an infant who is seated on the device, as well as to provide support for a belt which passes through the molded seat and functions to secure the seat to the waist of the wearer. While this type of infant carrier is relatively comfortable for the both the infant and wearer, it can be difficult to manufacture in that it is not a simple matter to accurately position the reinforcing member in the mold during the manufacturing process. Also, this type of infant carrier is disadvantageous in that the molded material tends to flake and decompose with time, and it is not readily washable to rid the seat of dirt and other contaminants which are absorbed by such materials. While the foamed seat may be dipped or sprayed with a non-porous, dirt-resisting vinyl or latex-type sealer, this adds to the product cost and only alleviates the aforementioned problems.

SUMMARY OF THE INVENTION

In view of the foregoing, it is an object of this invention to provide an improved infant carrier which is substantially free of the aforementioned problems of the prior art devices.

A preferred form of the infant carrier of the invention basically comprises a fabric belt adapted to e worn about the waist line of the intended wearer, and an integral fabric seat portion which is adapted to receive and support an infant who is seated to face the adult wearer with legs straddling the wearer's waist. The seat portion is defined by a section of the belt, a loop of fabric extending from such belt section, and a pair of spaced gussets connecting the belt section and the loop portion at spaced locations. A compressible material, such as a preformed polyurethane or foam rubber member or a bladder of air, is disposed in the volume defined by the aforementioned seat-defining members. By virtue of the integral belt/seat design, described in more detail below, the weight of the infant is more broadly distributed about the wearer's waist and hip region, and the product is more readily manufactured compared to prior art infant carriers of the same type.

The invention and its various advantages will become more evident to those skilled in the art from the ensuing detailed description of preferred embodiments, reference being made to the accompanying drawings.

DETAILED DESCRIPTION OF PREFERRED EMBODIMENTS

Figure 6:
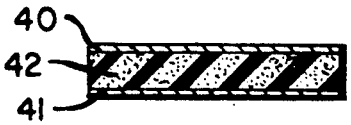
FIG. 6 is a cross-sectional illustration taken along the section line 6—6 of FIG. 2.
Figure 7:
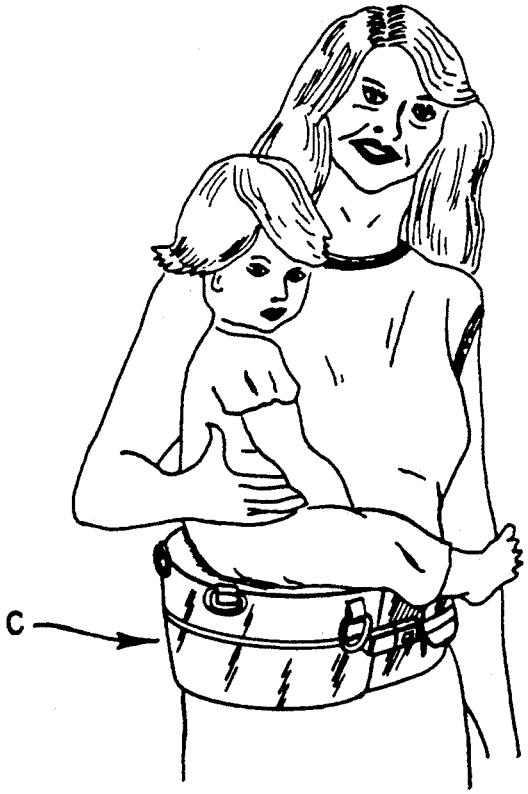
FIG. 7 is an illustration of the infant carrier shown FIGS. 1–4 in use.

Referring now to the drawings, FIGS. 1–4 illustrate a preferred embodiment of the infant carrier of the invention. In this particular embodiment, the infant carrier C comprises a belt section 10 adapted to be worn about the waist of an adult, and a seat portion 12 which, as shown in FIG. 7, is adapted to support an infant who is positioned to face the adult with legs straddling the adult's waistline. The seat portion is integral with the belt and is positioned along the inside surface 10A of the belt. Thus, when worn by the adult user, the belt encompasses both the user and the seat. Preferably, the belt and most of the elements defining the exterior of its integral seat are made of synthetic fabrics, such as dacron, nylon or polyester. Particularly preferred, is a laminate structure (shown in FIG. 6) comprising a polypropylene outer shell 40, a brushed nylon inner shell 41, and a thin (e.g. ¼ to ½ inch thick) intermediate layer of foamed polyurethane or foam rubber 42.

Figure 1:
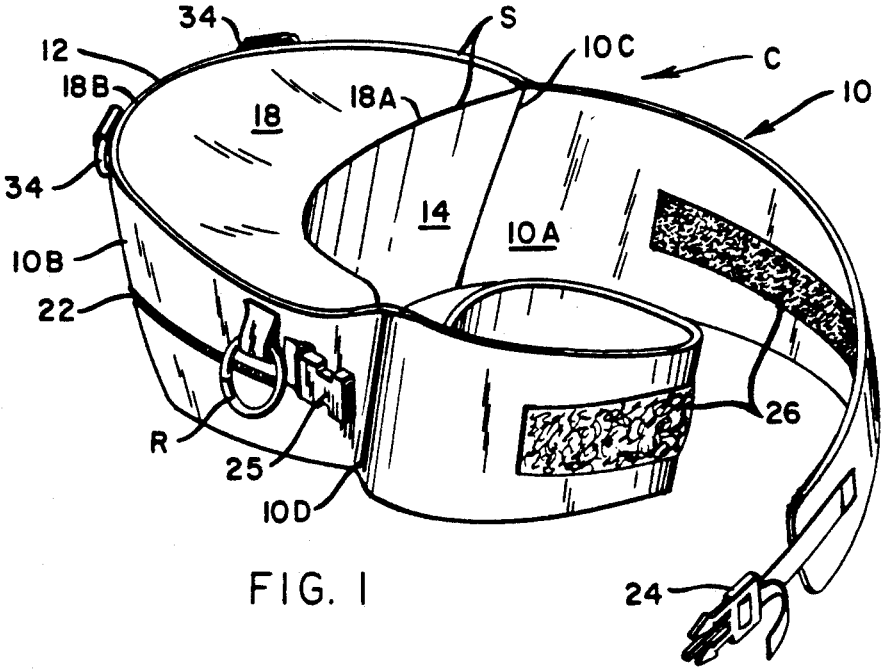
FIG. 1 is a perspective view of a preferred embodiment of the infant carrier of the invention.
Figure 2:
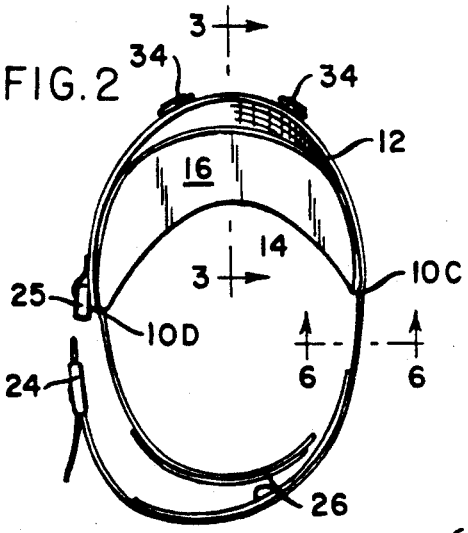
FIG. 2 is a top view of the carrier shown in FIG. 1.
Figure 3:
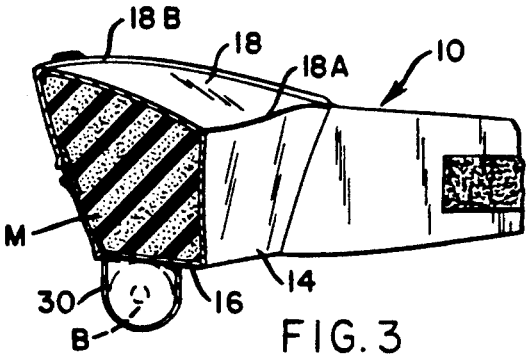
FIG. 3 is a sectional view taken along the section line 3—3 in FIG. 2.
Figure 4:
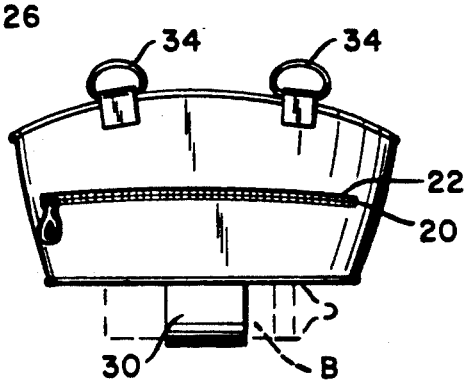
FIG. 4 is a front elevation of the FIG. 1 device.

The seat portion of the above infant carrier is defined by a portion 10B of the belt section, a loop 14 of fabric extending away from and back to the inside surface 10A of the belt at spaced locations 10C and 10D, and a pair of gussets 16 and 18 which interconnect belt portion 10B and loop 14 along seam lines S. The gussets are positioned one above the other, the lower gusset 16 being smaller in size than the upper gusset 18 and substantially horizontal when the carrier is in use. Preferably, the upper gusset is disposed at an angle with respect to the lower gusset, thereby giving the seat volume a somewhat wedge-shaped cross-section, as shown in FIG. 3. By positioning the inside edge 18A of the upper gusset at a lower level than the outer edge 18B, a supported infant is urged toward the waistline of the wearer. Both upper and lower gussets are made of nylon. Preferably, that side of the loop 14 facing the waist of the user is lined with a fabric comprising a natural material.

The volume defined by the above-mentioned seat-defining members is filled with a shaped (e.g., injection molded) compressible member M, such as a medium density foam rubber or polyurethane. Alternatively, the seat volume may be filled with an air bladder or the like, whereby the hardness of the seat can be adjusted by varying the air pressure within the bladder. Such a bladder can be made of rubber or vinyl. The shape of the compressible member is determined by the dimensions of the seat defining members. Access to the interior of the seat portion can be gained through an opening 20 which can be formed in any one of the seat-defining members, but is preferably located in belt portion 10B. Opening 20 can be opened and closed by a zipper 22 or the like. Thus, the compressible member may be removed from the seat portion, for example, to facilitate washing of the infant carrier.

Figure 5:
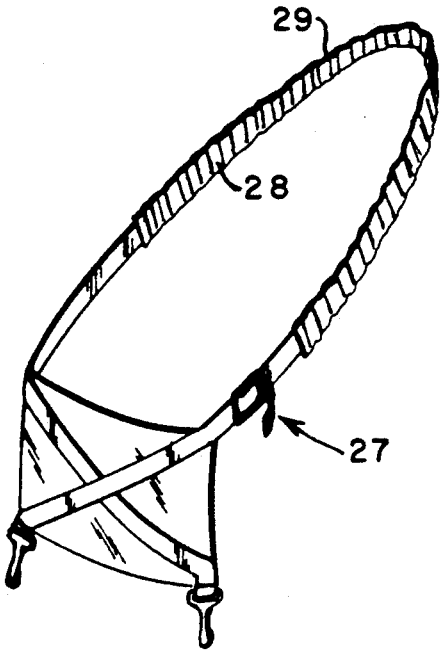
FIG. 5 illustrates an optional strap adapted for use with the carrier of FIGS. 1–4.

For saftey purposes, belt section 10 is provided with plural means for securing the belt about the user's waist. For example, a mechanical snap 24 at one end of the belt which cooperates with a mating member 25 located on another portion of the belt can be supplemented with a hook and loop or a VELCRO-type clasp 26 positioned on opposing surfaces of the belt when worn. To provide support for an infant's back, and at the same time free-up the arm of the user, an optional back strap 27, shown in FIG. 5 can be attached to a pair of rings 34 sewn into the upper outside seam of the belt/gusset 18 interface. Backstrap 27 comprises an elastic band 28 which is to be worn about the neck of the carrier user, and a non-stretchable nylon band 29 which is sewn to the elastic band at equally spaced locations and serves to limit the amount of stretch of the band. The carrier of the invention also features an elastic loop of material 30 for carrying a baby bottle B, and a metal or plastic ring R for keys K or the like.

In contrast with the foam rubber infant carrier disclosed in the aforementioned U.S. Pat. No. 4,901,898, the infant carrier of the invention affords certain real advantages. For example, since the compressible material is totally enclosed by the fabric members, there is no flaking and decomposure of the resilient material. Since the outer edge of the seat portion is defined by portion 10B of the belt, such edge is prevented from bending over and deflecting by the weight of the infant. Moreover, placement of the belt at the extreme outer edge of the seat, as opposed to at the waist of the wearer, changes the fulcrum point about which the seat tends to pivot when in use, whereby a more uniform and lower pressure is created against the waistline of the user, and the direction of the load is more vertically oriented.

While the invention has been described with particular reference to preferred embodiments, obvious variations can be made without departing from the spirit of the invention. Such variations are intended to fall within the scope of the invention, as defined by the following claims.

What is claimed is:

1. An infant carrier adapted to be worn about the waist of an adult for supporting and transporting an infant on the hip region of the wearer, said infant carrier comprising a belt adapted to be worn about the waist line of an intended wearer, said belt having an integral seat portion which is adapted to receive and support the buttocks of an infant who is positioned to face the adult wearer with legs straddling the wearer's waist, said integral seat portion being defined by a section of the belt, a loop of material extending outwardly from such belt section at a first location, and back to said belt section at a second location spaced from the first location, and upper and lower spaced crescent-shaped gussets connecting the belt section and the loop, whereby said section of the belt, said loop of material and said crescent-shaped gussets define an enclosed volume, said integral seat portion further comprising a pre-shaped compressible member disposed within and substantially filling said volume.

2. The infant carrier as defined by claim 1 wherein said pre-shaped compressible member has a crescent-shaped cross-section and comprises polyurethane or foam rubber.

3. The infant carrier as defined by claim 2 wherein either said loop of material, said belt section or one of said gussets defines an opening communicating with said volume, whereby said shaped compressible member can be inserted into or removed from said volume.

4. The infant carrier as defined by claim 1 wherein said belt comprises a pair of straps extending from said integral seat portion, said straps being adapted to be wrapped about the waist of the wearer and collectively supporting a hook and loop clasp which secures said straps together about the waist of the wearer.

5. The infant carrier as defined by claim 4 further comprising a a mechanical clasp for securing said straps about a wearer's waist.

6. The infant carrier as defined by claim 1 wherein said belt is made from a laminate structure comprising two layers of synthetic fabric materials having a layer of polyurethane sandwiched therebetween.

7. The infant carrier as defined by claim 6 wherein a side of the belt section facing and positioned adjacent the waist of the wearer is lined with a fabric comprising a natural material.

8. The infant carrier as defined by claim 1 wherein said upper gusset is larger in area than said lower gusset, whereby said seat-defining members define a tapered volume, and wherein said pre-shaped member is shaped to substantially fill said volume.

9. The infant carrier as defined by claim 1 wherein said upper gusset defines an upper surface for supporting an infant, and wherein said upper gusset is angularly disposed with respect to a horizontal plane, whereby the upper surface of said seat portion is inclined so as to urge a supported infant toward the waist of the wearer.

10. An infant carrier adapted to be worn about the waist of an adult for supporting and transporting an infant on the hip region of the wearer, said infant carrier comprising a belt adapted to be worn about the waist line of an intended wearer, said belt having an integral seat portion which is adapted to receive and support the buttocks of an infant who is positioned to face the adult wearer with legs straddling the wearer's waist, said integral seat portion being defined by a section of the belt, a loop of material extending outwardly from and back to said belt section, and a pair of spaced crescent-shaped gussets connecting the belt section and the loop portion, whereby said section of the belt, said loop of material and gussets said pair of define an enclosed volume for receiving a pre-shaped compressible material.

11. The infant carrier as defined by claim 10 wherein said compressible material comprises polyurethame, foam rubber, or a bladder of air.

12. The infant carrier as defined by claim 10 wherein either said loop of material, said belt section or one of said gussets defines an opening communicating with said volume, whereby said compressible material can be inserted into or removed from said volume.

13. The infant carrier as defined by claim 10 wherein said belt and seat-defining members are made of a synthetic fabric.

14. The infant carrier as defined by claim 10 wherein a side of the belt section facing and positioned adjacent the waist of the wearer is lined with a fabric comprising a natural material.

15. The infant carrier as defined by claim 10 said seat defining members define a tapered volume.

16. The infant carrier as defined by claim 10 wherein the upper gusset defines an upper surface for supporting an infant, and wherein said upper gusset is angularly disposed with respect to a horizontal plane when said pre-shaped compressible material is disposed within said volume, whereby the upper surface of said seat portion is inclined so as to urge a supported infant toward the waist of the wearer.

17. The infant carrier as defined by claim 10 wherein said belt comprises a pair of straps extending from said integral seat portion, said straps being adapted to be wrapped about the waist of the wearer and collectively supporting a hook and loop clasp which functions to secure said straps together about the waist of the wearer.

18. The infant carrier as defined by claim 17 further comprising a a mechanical clasp for securing said straps about a wearer's waist.

* * * * *